US008840176B2

(12) United States Patent
Mouradian

(10) Patent No.: US 8,840,176 B2
(45) Date of Patent: Sep. 23, 2014

(54) HEATED AND/OR COOLED HOME AND OFFICE FURNISHINGS

(76) Inventor: Dean Mouradian, Brookfield, WI (US)

( * ) Notice: Subject to any disclaimer, the term of this patent is extended or adjusted under 35 U.S.C. 154(b) by 63 days.

(21) Appl. No.: 13/416,373

(22) Filed: Mar. 9, 2012

(65) Prior Publication Data

US 2012/0228904 A1 Sep. 13, 2012

Related U.S. Application Data

(60) Provisional application No. 61/451,415, filed on Mar. 10, 2011.

(51) Int. Cl.
*A47C 7/72* (2006.01)
*A47C 7/74* (2006.01)

(52) U.S. Cl.
CPC ..... *A47C 7/74* (2013.01)
USPC ..... 297/180.1; 297/180.12

(58) Field of Classification Search
CPC ..... A47C 7/72; A47C 7/74; A47C 7/744; A47C 7/748
USPC ..... 297/180.1, 180.12, 180.13, 180.14, 297/217.3
See application file for complete search history.

(56) References Cited

U.S. PATENT DOCUMENTS

| | | | | |
|---|---|---|---|---|
| 5,382,075 | A * | 1/1995 | Shih | 297/180.14 |
| 5,692,952 | A * | 12/1997 | Chih-Hung | 454/120 |
| 6,263,530 | B1 * | 7/2001 | Feher | 5/423 |
| 6,786,273 | B2 * | 9/2004 | Ichigaya | 165/46 |
| 8,505,320 | B2 | 8/2013 | Lofy | |
| 8,516,842 | B2 | 8/2013 | Petrovski | |
| 2010/0146700 | A1 * | 6/2010 | Wolas | 5/423 |
| 2010/0320819 | A1 * | 12/2010 | Cohen et al. | 297/217.4 |

* cited by examiner

*Primary Examiner* — Philip Gabler
(74) *Attorney, Agent, or Firm* — Ryan Kromholz & Manion, S.C.

(57) ABSTRACT

A heated and cooled seating unit is disclosed with an apparatus to determine if the chair is in use, such as a pressure sensor, or an electric sensing apparatus. This apparatus controls the heating apparatus and powers the heat off, to conserve power, in the event that a person or object is not seated in the chair.

3 Claims, 3 Drawing Sheets

HEATED AND/OR COOLED HOME AND OFFICE FURNISHINGS

RELATED APPLICATION

This application claims the benefit of U.S. Provisional Patent Application Ser. No. 61/451,415, filed 10 Mar. 2011.

BACKGROUND OF THE INVENTION

This invention relates to furniture, particularly to chairs, seats and the like. Heated seats, such as in automobiles, provide a level of comfort to users particularly during cold weather months. In addition, cooled seats are desirable in hot and humid conditions.

Heaters used in these types of seats require a power source. In the case of heated seats in automobiles, the seats are hard-wired into the power systems of the vehicles, or portable seat cushions are provided with a DC power source.

In settings such as home or office, seats and chairs are desirably mobile. A power cord would thus interfere with and limit the mobility of the seats.

SUMMARY OF THE INVENTION

A heated and/or cooled task chair is provided without the necessity for a dedicated hard wired power source.

In a preferred embodiment, the chair will have a heating apparatus located in the seat and or the back. This heating apparatus may comprise one or more of: flexible heating elements, conductive heating yarns, flexible conductive fabrics, or heated elements stitched into the fabrics of the seating apparatus.

Preferably, the chair has an electric switch to control the heating of the chair. This switch can be positioned in a location visible while seated in the chair. The switch can have an Off, On, Low, Medium & High settings. It may also have indicator light(s) to determine the status of the heating element and or the battery that supplies the heating apparatus. This switch may also provide independent switching of the seat and/or the back heating apparatus.

The chair may have a rechargeable power source (Battery) located on it to provide power to the heating apparatus. This rechargeable power source may be charged by connecting a cord from the chair or an AC power source, or it may be able to be removed and placed into a charging unit. A connector to charge the battery may be located on the battery or directly built into the chair. In an alternative embodiment, the chair may use wireless technology to charge battery or power the chair.

The chair may have standard tilt, swivel, height adjustment and rolling swivel casters similar to a typical office chair.

In another aspect of the present invention, the chair may have an apparatus to determine if the chair is in use, such as a pressure sensor, or an electric sensing apparatus. This apparatus will control the heating apparatus and power the heat off, to conserve power, in the event that a person or object is not seated in the chair.

This chair may be a standard office chair typically found in the work place or any chair found in the home office, but will provide heat and or cooling to the user.

This chair will have heating or cooling elements that may be electric or any other method of producing heat or cooling effect. These elements can be located anywhere in the chair, including but not limited to the seat, the back, the lumbar, the arm rests, head rest or the base.

The chair preferably has an electric switch to control the heating of the chair which may be positioned in a location visible while seated in the chair. The switch can have an Off, On, and may have variable power settings. It may also have indicator light(s) to determine the status of the heating element and or the status of the battery that supplies the heating/cooling apparatus. This switch may also provide independent switching of the Seat and or the Back heating apparatus. In addition, the chair may also include a method of sensing if the chair is in use. This will allow the chair to automatically adjust the power supply or turn the chair off when not in use to conserve energy. This device may be a sensor to determine if the chair is in use by weight or current consumption of heating or cooling elements.

The chair preferably has a rechargeable power source (Battery) located on or in it to provide power to the heating or cooling apparatus. This (Battery) may be charged Wirelessly, or by connecting a cord from the chair to a power source, or it may be able to be removed and placed into a charging unit. Connector to charge the battery may be located on the (Battery or directly built into the chair.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
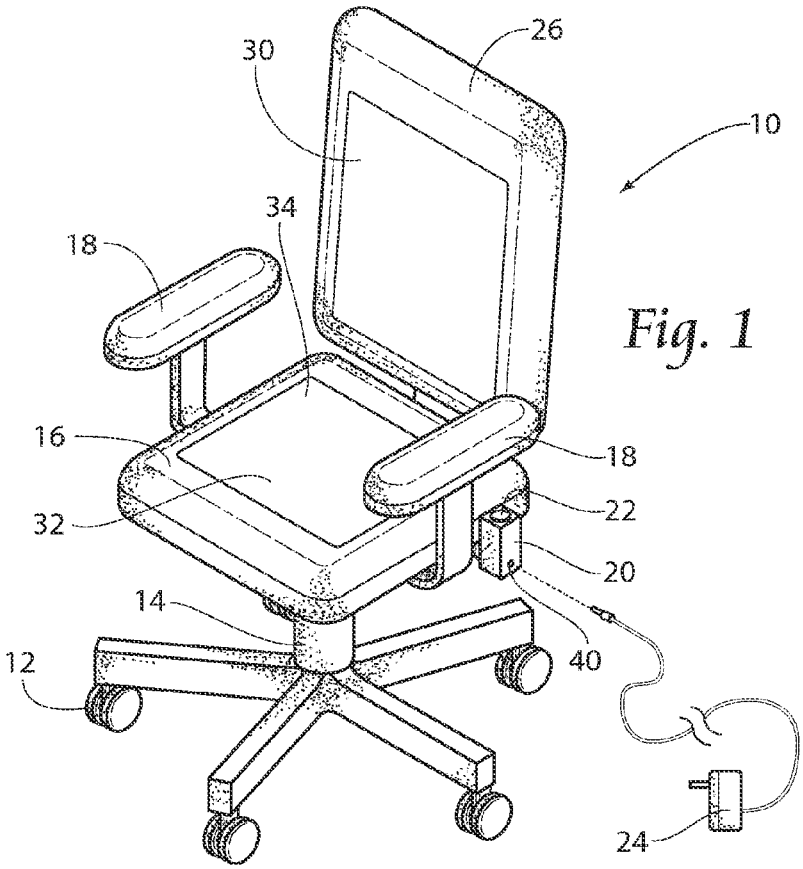
FIG. 1 is a perspective view of a chair of the present invention.

Referring now to FIG. 1, a perspective view of a chair 10 of the present invention is shown. Provided are heating elements 30 and 32 located in the seat of the chair and/or in the back of the chair as will be described later. The chair is provided with casters 12 which carry a leg or legs 14, to hold seat 16. Armrests are carried by the seat 16, and the seat 16 has a backrest 26. Heating elements 30 and/or 32 are powered on and off by a power switch 22, carried by a switch box 20 coupled to the seat 16. A detachable power charging cord 24 is detachably coupled to the switch box 20, which is also coupled to a battery box 28 carrying a battery (see FIG. 2).

Instead of or in addition to power switch 22, the chair 10 can be provided with a wired or wireless remote control to operate the chair.

A pressure sensor 34 is provided, preferably contained within the seat 16, to determine if the chair is in use (occupied). The pressure sensor 34 can take the form of a weight sensor, pressure sensor, or electrical conductivity sensor, for example. The pressure sensor 34 communicates with the heating elements 30 and/or 32, and heat is discontinued in the event that a person or object is not seated in the chair.

Figure 2:
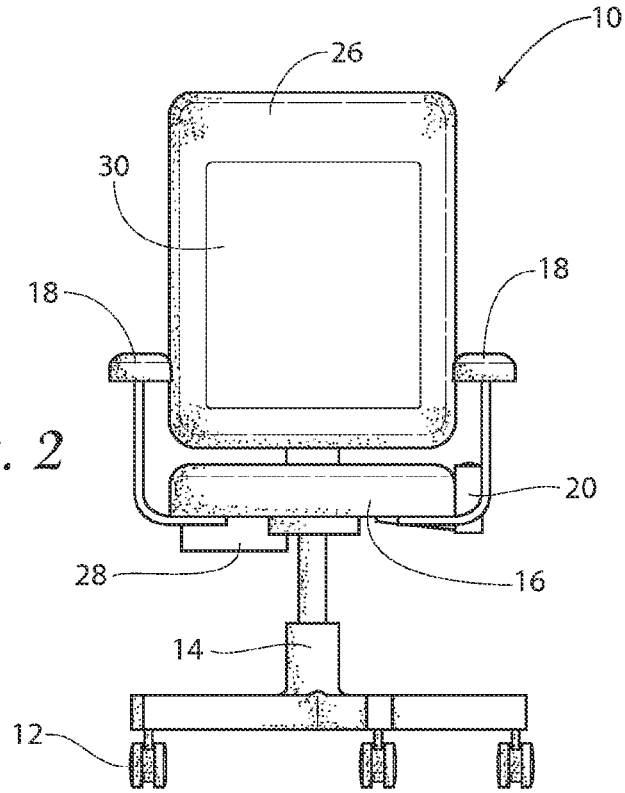
FIG. 2 is a front view of the chair of the present invention.

Referring now to FIG. 2, a front view of the chair 10 of the present invention is shown. The chair 10 may or may not have casters 12 as are shown in the drawing. Preferably, the chair has a lever to control seat position (not shown). The chair may have a Heating/Cooling elements 30 and 32 located in the Back, Lumbar pad or head rest portions of the chair. The heating elements 30 and 32 may comprise flexible electric heating elements, conductive heating yarns, flexible conductive fabrics or chemical means.

The chair may have a back 26 that is supported in any method including, but not limited to arms, or vertical post. This back may be comprised of any material including padding, plastic, wood, steel, or cloth. It may be solid, perforated or flexible.

Figure 3:
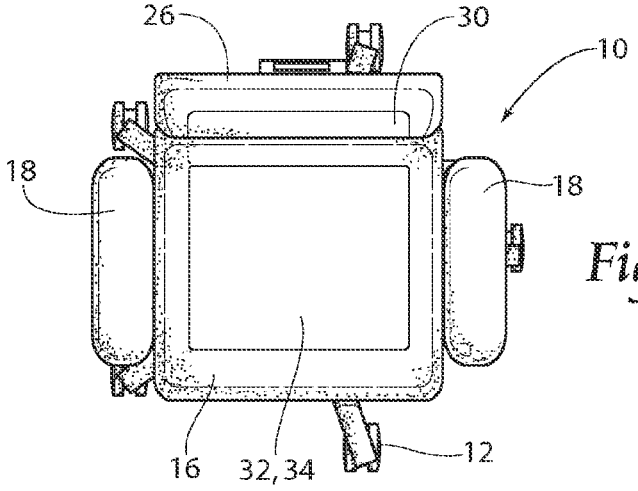
FIG. 3 is a top view of the chair of the present invention.
Figure 4:
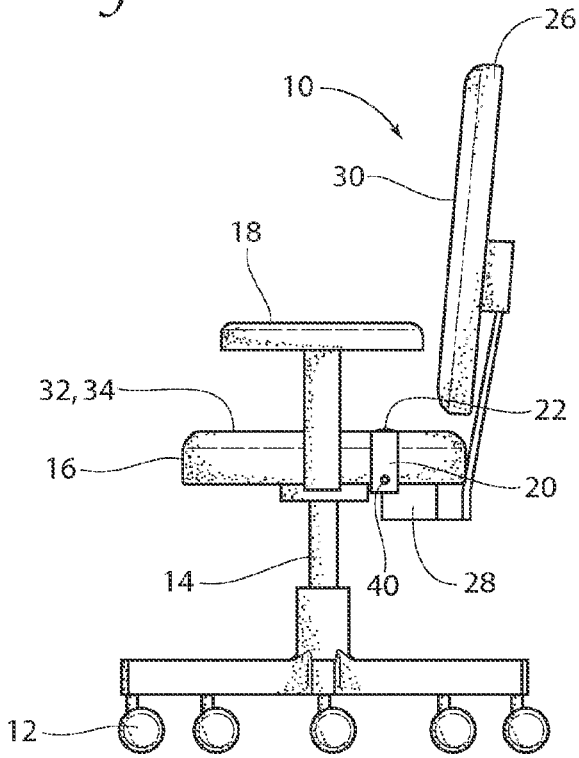
FIG. 4 is a side view of the chair of the present invention.
Figure 5:
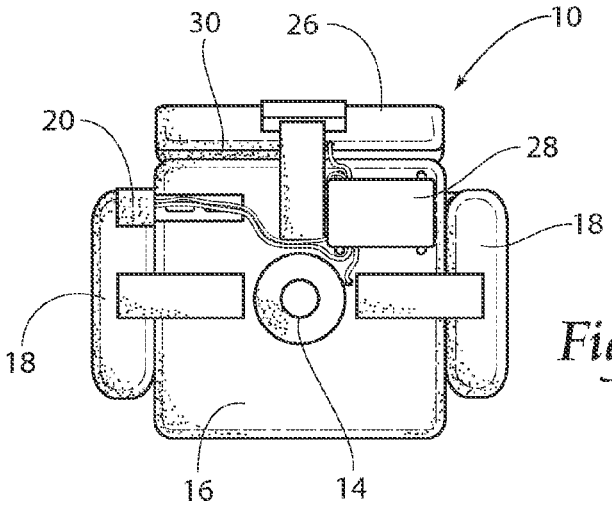
FIG. 5 is a bottom view of the chair of the present invention.

Referring now to FIGS. 3, 4 and 5, a top view, side view, and a bottom view of the chair 10 are shown.

The chair has an electric switch 22 to control the heating of the chair. This switch 22 is preferably positioned in a location that may be visible while seated in the chair. The switch can have an Off, On, Low, Medium & High settings. The chair may also have indicator light(s) to determine the status of the heating element and or remaining power in the battery that supplies the heating apparatus. This switch 22 may also provide independent switching of the Seat and or the Back heating apparatus.

The chair has a seat 16 that is supported in any method, and may be comprised of any material including padding, plastic, wood, steel, or cloth. It may be solid, perforated or flexible. Swivel and/or tilt mechanism 17 are provided for user adjustability.

The power source of the chair is preferably a rechargeable power source (Battery) located on or in a battery box 28 to provide power to the heating/cooling apparatus.

The power source located on or in a battery box 28 (Battery) may be charged by connecting a detachable power charging cord 24, which is detachably coupled to the switch box 20, which is also coupled to a battery box 28 carrying a battery, or it may be able to be removed and placed into a charging unit.

Optionally, a USB cable can be used as a detachable power charging cord 24 to run, charge, operate, or gain feedback from the chair 10 via USB.

The power source for this chair 10 may also be able to be charged wirelessly. The detachable power charging cord 24 may also be coupled directly to the battery box 28 if desired. The heating/cooling devices may be able to be operated while the battery is being charged. A switch 22 is provided to control all or any of the heating elements 30 and 32, with adjustability provided for off, low, medium and high heat, with indicator lights showing the power status of the heating elements.

A sensor 34 is provided to determine if the seat 16 is occupied. If the seat 16 is not occupied, it is preferable to decrease or turn off the heating elements.

A recessed male electrical connection 40 with a detachable power cord 24 to power heating elements 30 and 32 and charge the battery unit is shown. It is preferred that the battery box 28 be positioned behind the user when seated, so that the knees of the user are not impaired.

It is preferable that the seat back 26 and seat 16 are made of a soft material covered with a thin layer of material capable of passing heat. The back 26 and seat 16 may also be made from a thermally conductive textile material.

The chair 10 can be provided with heat in the seat only, or heat in the seat and the lumbar, or heat in the lumbar only.

Figure 6:
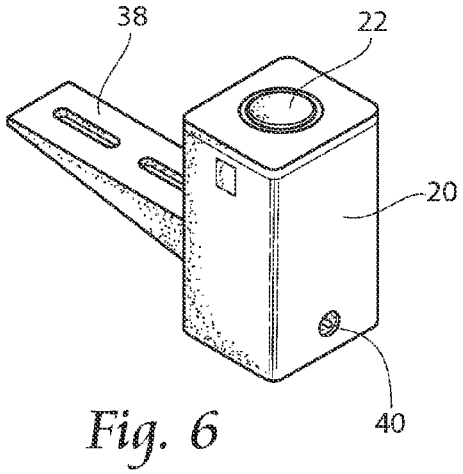
FIG. 6 is a perspective view of a switch box and power switch of the present invention.

Referring now to FIG. 6 a perspective view of a switch box 20 carrying power switch 22 is shown. A flange 38 is provided to couple the switch box 20 preferably to the underside of the seat 10. The recessed male electrical connection 40 is visible, where the detachable power cord 24 is plugged in to power heating elements 30 and 32

Figure 7:
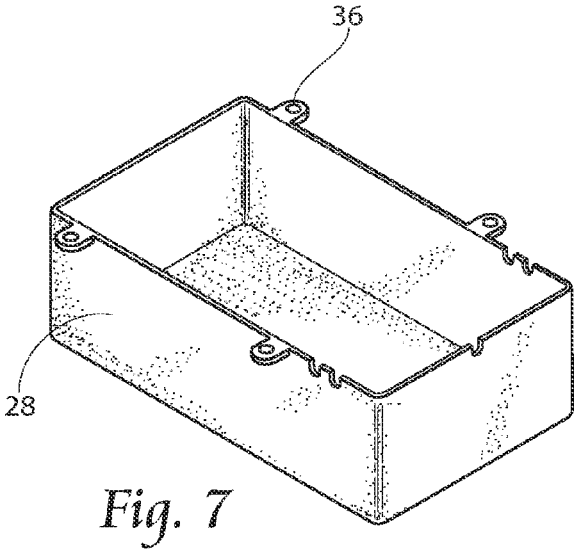
FIG. 7 is a perspective view of a battery box of the present invention.

Referring now to FIG. 7, perspective view of a battery box 28 of the present invention is shown, which is used to house or carry a battery (not shown). Connection tabs 36 are used to couple the battery box 28 preferably to the underside of chair 10.

Figure 8:
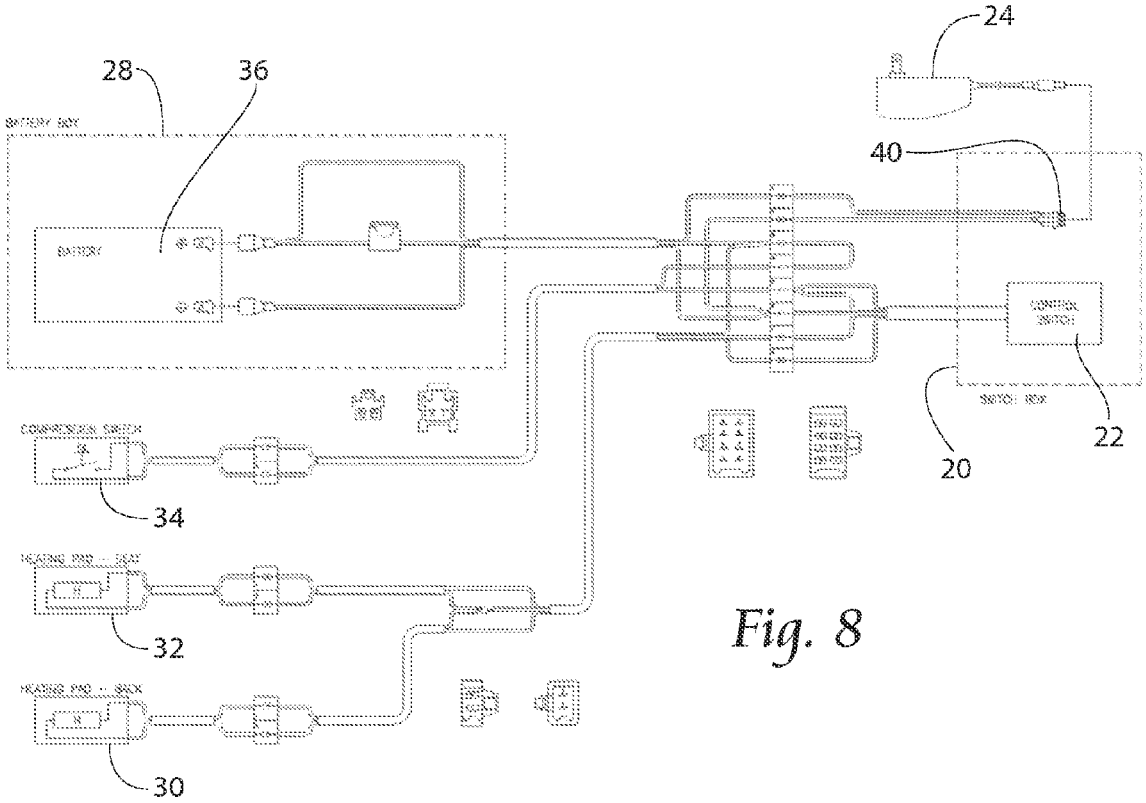
FIG. 8 is an electrical schematic of the chair of the present invention.

Referring now to FIG. 8, an electrical schematic of the chair 10 is shown. Preferably located inside the seat 16 are the compression switch 34, and the seat heating pad 32. A separate heating pad 30 is also provided in seat back 26, and the aforementioned elements are coupled to the control switch 22 residing in switch box 20. The battery 36 is carried by the battery box 28, and those elements are detachably coupled to external recharging power source 24 through the switch box 20 at recessed male electrical connection 40.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A chair comprising:

a leg carrying a seat;

a heat source carried by said seat;

a rechargeable power source carried by said seat, said rechargeable power source coupled to said heat source, and detachably coupled with a recharging power source;

a switch to turn said heat source on and off, said switch coupled with said rechargeable power source and said heat source;

said rechargeable power source carried by a battery box coupled to an underside of said seat;

said switch carried by a switch box carried by said underside of said seat and positioning said switch on a side of said seat, said switch box having an opening for a recessed male electrical connection to couple said rechargeable power source and said recharging power source;

said battery box comprising side facing walls and openings in said walls for carrying wires between said switch box and an interior of said battery box.

2. A chair according to claim 1, said recharging power source comprising a USB cable.

3. A chair according to claim 1, said chair further comprising a seat back coupled to said seat, said seat back carrying a lumbar heat source carried by said seat back, said lumbar heat source coupled to said rechargeable power source and said switch to turn said lumbar heat source on and off.

* * * * *